US009016255B2

(12) United States Patent
Cleeves et al.

(10) Patent No.: US 9,016,255 B2
(45) Date of Patent: Apr. 28, 2015

(54) SEALING OF SLEEVE VALVES

(75) Inventors: James M. Cleeves, Redwood City, CA (US); Michael Hawkes, San Francisco, CA (US)

(73) Assignee: Pinnacle Engines, Inc., San Carlos, CA (US)

( * ) Notice: Subject to any disclaimer, the term of this patent is extended or adjusted under 35 U.S.C. 154(b) by 602 days.

(21) Appl. No.: 13/270,192

(22) Filed: Oct. 10, 2011

(65) Prior Publication Data

US 2012/0085309 A1 Apr. 12, 2012

Related U.S. Application Data

(60) Provisional application No. 61/391,519, filed on Oct. 8, 2010, provisional application No. 61/501,654, filed on Jun. 27, 2011.

(51) Int. Cl.

| | |
|---|---|
| ***F01L 5/00*** | (2006.01) |
| ***F02B 75/28*** | (2006.01) |
| ***F01L 5/06*** | (2006.01) |
| ***F01L 5/18*** | (2006.01) |

(Continued)

(52) U.S. Cl.

CPC . *F02B 75/28* (2013.01); *F01L 5/12* (2013.01); *F01L 7/00* (2013.01); *F01L 5/08* (2013.01); *F01L 5/02* (2013.01); *F01L 3/08* (2013.01); *F01L 5/06* (2013.01); *F01L 5/18* (2013.01); *F01L 5/24* (2013.01)

(58) Field of Classification Search

CPC ..... F01L 7/00; F01L 3/08; F01L 5/02; F01L 5/08; F01L 5/12

USPC ..... 123/188.5

See application file for complete search history.

(56) References Cited

U.S. PATENT DOCUMENTS

| | | | | |
|---|---|---|---|---|
| 7,559,298 | B2 | 7/2009 | Cleeves | |
| 2007/0028866 | A1* | 2/2007 | Lindsay | 123/51 BA |
| 2008/0135001 | A1* | 6/2008 | Dingle | 123/90.1 |
| 2010/0212622 | A1 | 8/2010 | Cleeves | |

FOREIGN PATENT DOCUMENTS

| | | |
|---|---|---|
| DE | 643470 C | 4/1937 |
| DE | 671919 C | 2/1939 |

(Continued)

OTHER PUBLICATIONS

PCT International Search Report and Written Opinon dated Jan. 27, 2012, issued for PCT application No. PCT/US2011/055503.

*Primary Examiner* — Lindsay Low
*Assistant Examiner* — Charles Brauch
(74) *Attorney, Agent, or Firm* — Mintz Levin Cohn Ferris Glovsky and Popeo, P.C.

(57) ABSTRACT

A sleeve valve with a valve body that at least partially encircles at least one piston that moves in a reciprocating manner can, at least partially define with the at least one piston a combustion chamber of an internal combustion engine. A valve actuation mechanism can move the sleeve valve between an open position and a closed position to control flow through a port of the internal combustion engine. The sealing edge of the sleeve valve can be urged against a valve seat by an urging force generated by the valve actuation mechanism when the sleeve valve is moved to the closed position. At least one of the sleeve valve and the valve seat can include a valve assistance feature that assists the valve actuation mechanism in resisting forces generated by the internal combustion engine in opposition to the urging force. Related articles, systems, and methods are described.

19 Claims, 13 Drawing Sheets

(51) Int. Cl.

| | |
|---|---|
| ***F01L 5/24*** | (2006.01) |
| *F01L 5/12* | (2006.01) |
| *F01L 7/00* | (2006.01) |
| *F01L 5/08* | (2006.01) |
| *F01L 5/02* | (2006.01) |
| *F01L 3/08* | (2006.01) |

(56) References Cited

FOREIGN PATENT DOCUMENTS

| | | | |
|---|---|---|---|
| FR | 436711 | A | 4/1912 |
| FR | 715366 | A | 12/1931 |

* cited by examiner

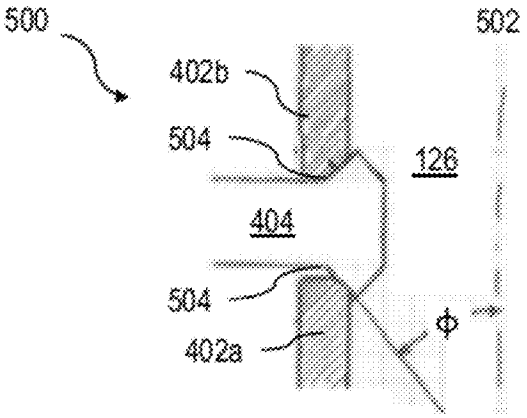
FIG. 5B
FIG. 5A
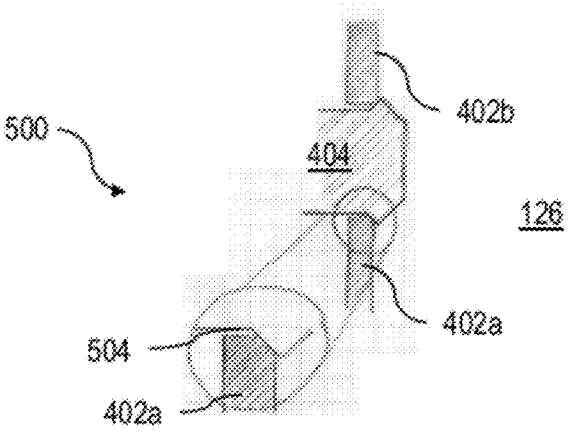
FIG. 5D
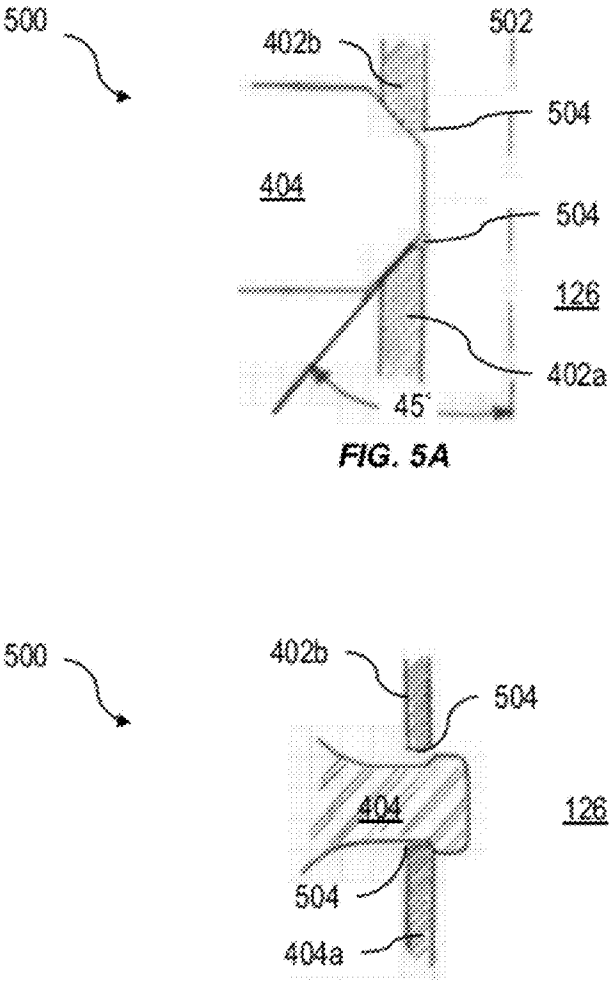
FIG. 5C

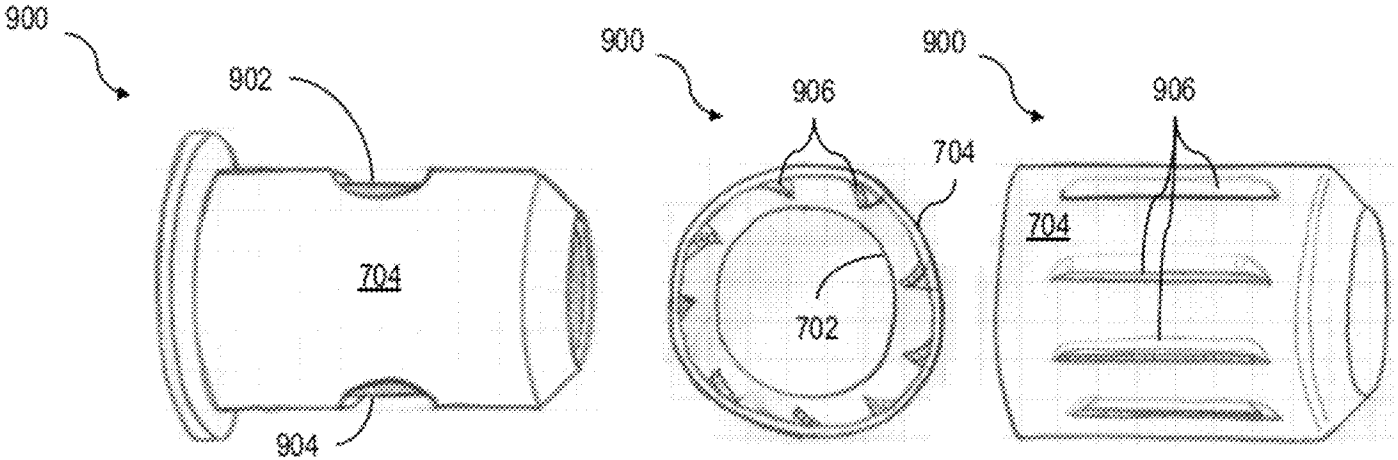
FIG. 9A
FIG. 9B
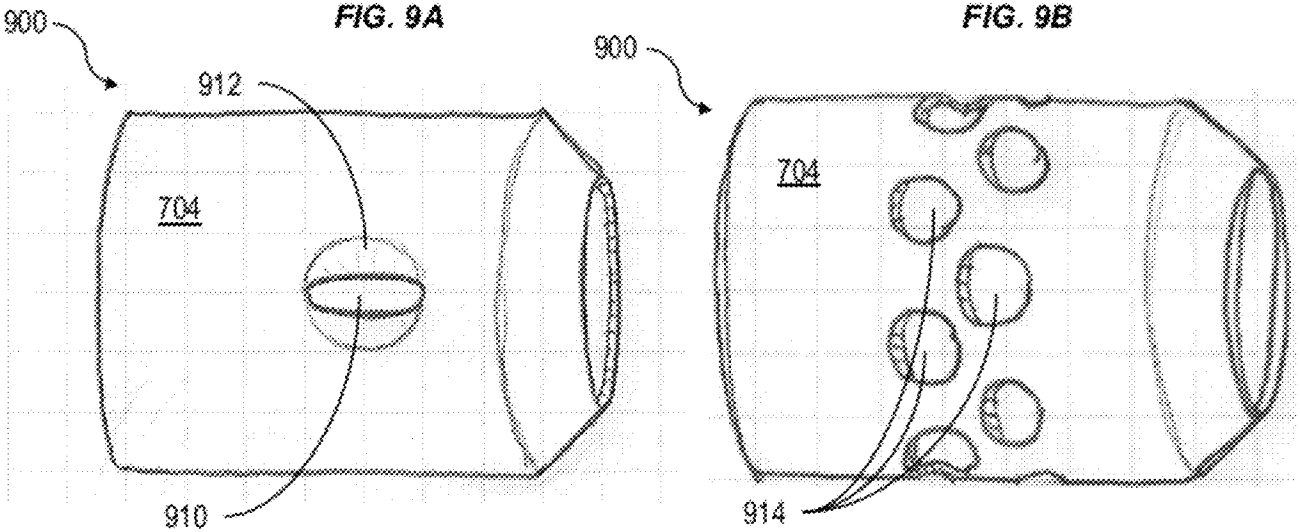
FIG. 9C
FIG. 9D

SEALING OF SLEEVE VALVES

CROSS-REFERENCE TO RELATED APPLICATIONS

This application claims priority under 35 U.S.C. §119(e) to U.S. provisional patent application Ser. No. 61/391,519, filed on Oct. 8, 2010 and entitled "Improved Internal Combustion Engine Valve Sealing," under 35 U.S.C. §119(e) to U.S. provisional patent application Ser. No. 61/501,654 filed on Jun. 27, 2011 and entitled "High Efficiency Internal Combustion Engine," and under 35 U.S.C. §120 to Patent Cooperation Treaty Application No. PCT/US2011/055503 filed on Oct. 8, 2011 and entitled "Improved Sealing of Sleeve Valves."

The current application is also related to co-owned U.S. Pat. No. 7,559,298, to co-owned and co-pending international application no. PCT/US2011/055457 entitled "Single Piston Sleeve Valve with Optional Variable Compression Ratio Capability," to co-owned and co-pending international application no. PCT/US2010/046095 entitled "High Swirl Engine," and to co-owned and co-pending international application no. PCT/US2011/055485 entitled "Positive Control (Desmodromic) Valve Systems for Internal Combustion Engines." The disclosure of each of the documents identified in this and the preceding paragraph is incorporated by reference herein in its entirety.

TECHNICAL FIELD

The present disclosure relates generally to the field of internal combustion engines and, in some implementations, to valve systems for use with sleeve valves.

BACKGROUND

A sleeve valve is a type of valve usable in internal combustion engines, including but not limited to opposed piston engines, in which two pistons share a single cylinder, and also in engines in which each piston reciprocates in its own cylinder. Such a valve typically forms all or a portion of the cylinder wall. In some variations, one or more sleeve valve can reciprocate back and forth substantially in parallel to an axis upon which one or more pistons reciprocates to open and close intake and/or exhaust ports at appropriate times to introduce air or an air-fuel mixture into the combustion chamber and/or to exhaust combustion products from the chamber. In other variations, one or more sleeve valve can rotate about and/or translate along the axis of the piston or pistons to open and close one or both of the intake and exhaust ports. Due to the potentially large circumferential port area that can be controlled by a sleeve valve, such valves can provide a relatively large cross sectional area for fluid flow in the open position.

SUMMARY

Consistent with various aspects of the current subject matter, systems can include one or more valve assistance features, such as for example an interference angle between a sleeve valve and a valve seat configured such that bending of the sleeve valve by combustion gas pressures does not open a gap between the sealing edge of the sleeve valve and the valve seat that exposes sufficient surface area for the combustion gas pressure to act upon to exert a counter force sufficient enough to overcome the mechanical forces holding the sleeve valve closed. Also potentially within the scope of the current subject matter are methods for adjusting the design of a sleeve valve system to allow for the larger bending forces of a low compression engine operation for a variable compression ratio engine as well as design and manufacturing attributes that can ensure that an advantageous geometry of sleeve valves and their corresponding seats can be maintained over a substantial useful life of the engine.

In one aspect, a system includes a sleeve valve including a valve body that at least partially encircles at least one piston that moves in a reciprocating manner. The sleeve valve and the at least one piston at least partially define a combustion chamber of an internal combustion engine. A valve actuation mechanism moves the sleeve valve between an open position and a closed position to control flow through a port of the internal combustion engine. The sealing edge of the sleeve valve is urged against a valve seal by an urging force generated by the valve actuation mechanism when the sleeve valve is moved to the closed position. At least one of the sleeve valve and the valve seat includes a valve assistance feature that assists the valve actuation mechanism in resisting forces generated by the internal combustion engine in opposition to the urging force. The forces generated by the internal combustion engine in opposition to the urging force include a pressure of combustion gases in the combustion chamber acting on an exposed surface of the sealing edge in a direction counter to a valve closing force of the valve actuation mechanism.

In an interrelated aspect, a method includes moving, by a valve actuation mechanism, a sleeve valve between an open position and a closed position to control flow through a port of an internal combustion engine. The sleeve valve includes a valve body that at least partially encircles at least one piston that moves in a reciprocating manner. The sleeve valve and the at least one piston at least partially define a combustion chamber of the internal combustion engine. The sealing edge of the sleeve valve is urged against a valve seat by an urging force generated by the valve actuation mechanism when the sleeve valve is moved to the closed position. A valve assistance feature assists valve actuation mechanism in resisting forces generated by the internal combustion engine in opposition to the urging force. At least one of the sleeve valve and the valve seat include the valve assistance feature or feature. The forces generated by the internal combustion engine in opposition to the urging force include a pressure of combustion gases in the combustion chamber acting on an exposed surface of the sealing edge in a direction counter to a valve closing force of the valve actuation mechanism.

In some variations one or more of the following features can optionally be included in any feasible combination. The valve actuation mechanism can optionally include a spring sized to ensure that the maximum gas pressure cannot lift the sealing edge off of the valve seat. The valve assistance feature can optionally include an interference angle between the sealing edge of the valve and the valve seat configured to reduce the exposed surface area by reducing formation of a gap opening between the sealing edge and the valve seat when the sleeve valve bends outwardly due to radially directed forces caused by combustion gas pressures in the combustion chamber. The interference angle can optionally include a difference between a first taper angle of the sealing edge and a second taper angle of the valve seat. The interference angle can optionally be formed between a first sealing surface on the sealing edge and a second sealing surface on the valve seat. The first sealing surface can optionally be shaped like a first section of a first tapering solid of rotation having a first apex toward which the first sealing surface tapers. The second sealing surface can optionally be shaped like a second section of a second tapering solid of rotation having a second apex toward which the second sealing surface tapers. The first tapering solid of rotation and the second tapering solid of rotation can optionally each share their axes of rotation with a central axis of the combustion chamber.

The first tapering solid of rotation can optionally include a first cone and the second tapering solid of rotation can optionally include a second cone. The first apex and the second apex can optionally both be oriented toward the closed position, or alternatively, the first apex and the second apex can optionally both be oriented toward the open position.

An oblique, or alternatively an acute interference angle can be formed between the first sealing surface and the second sealing surface. The interference angle can optionally be based on a calculated maximum deflection of the sleeve valve due to a maximum pressure of the combustion gases in the combustion chamber. The interference angle can optionally cause an inner edge of the sealing edge to remain in contact with the valve seat even at the maximum deflection.

The internal combustion engine can optionally include an opposed piston engine. In one optional variation of an opposed piston engine, the at least one piston can optionally include a leading piston at least partially encircled by the valve body and a trailing piston at least partially encircled by a second valve body of a second sleeve valve. The leading piston and the second piston can reciprocate between respective top dead center and bottom dead center positions in an out of phase manner such that the leading piston reaches its top dead center position prior to the trailing piston reaching its top dead center position to provide a variable compression ratio capability. The second sleeve valve can optionally include a second sealing edge that is urged against a second valve seat, and a second interference angle between the second sealing edge of the second sleeve valve and the second valve seat that is larger than the interference angle.

In a second optional variation of an opposed piston engine, the at least one piston can optionally include a primary piston at least partially encircled by the valve body and a secondary piston at least partially encircled by a second valve body of a second sleeve valve. The primary piston and the secondary piston can reciprocate between respective top dead center and bottom dead center positions on respective first and second crankshafts. The second crankshaft can be translatable along an axis of motion of the secondary piston such that the secondary piston in a lower compression ratio configuration has a top dead center position further from a center of the engine than the primary piston. The second sleeve valve can optionally include a second sealing edge that is urged against a second valve seat and a second interference angle between the second sealing edge of the second sleeve valve and the second valve seat that is larger than the interference angle.

The sealing edge can optionally include a plurality of angles. The plurality of angles can optionally include a first angle that softens or trims off an otherwise sharp edge of the sealing edge to eliminate overly rapid heating of the sealing edge, a second matched to an angle of the valve seat that can optionally include the interference angle, and a third, relief angle that is substantially steeper than a sleeve valve contact angle with the valve seat so that as the sleeve valve and the valve seat wear, the sleeve valve cannot bow so much that the sealing edge and the valve seat make contact in the third, relief region.

The details of one or more variations of the subject matter described herein are set forth in the accompanying drawings and the description below. Other features and advantages of the subject matter described herein will be apparent from the description and drawings, and from the claims.

DESCRIPTION OF DRAWINGS

The accompanying drawings, which are incorporated in and constitute a part of this specification, show certain aspects of the subject matter disclosed herein and, together with the description, help explain some of the principles associated with the disclosed implementations. In the drawings.

FIG. 5A, FIG. 5B, FIG. 5C, and FIG. 5D show cross-sectional diagrams illustrating features of sealing-enhanced sleeve valves;

FIG. 9A, FIG. 9B, FIG. 9C, and FIG. 9D show isometric diagrams illustrating cooling features of sleeve valves;

When practical, similar reference numbers denote similar structures, features, or elements.

DETAILED DESCRIPTION

Figure 1:
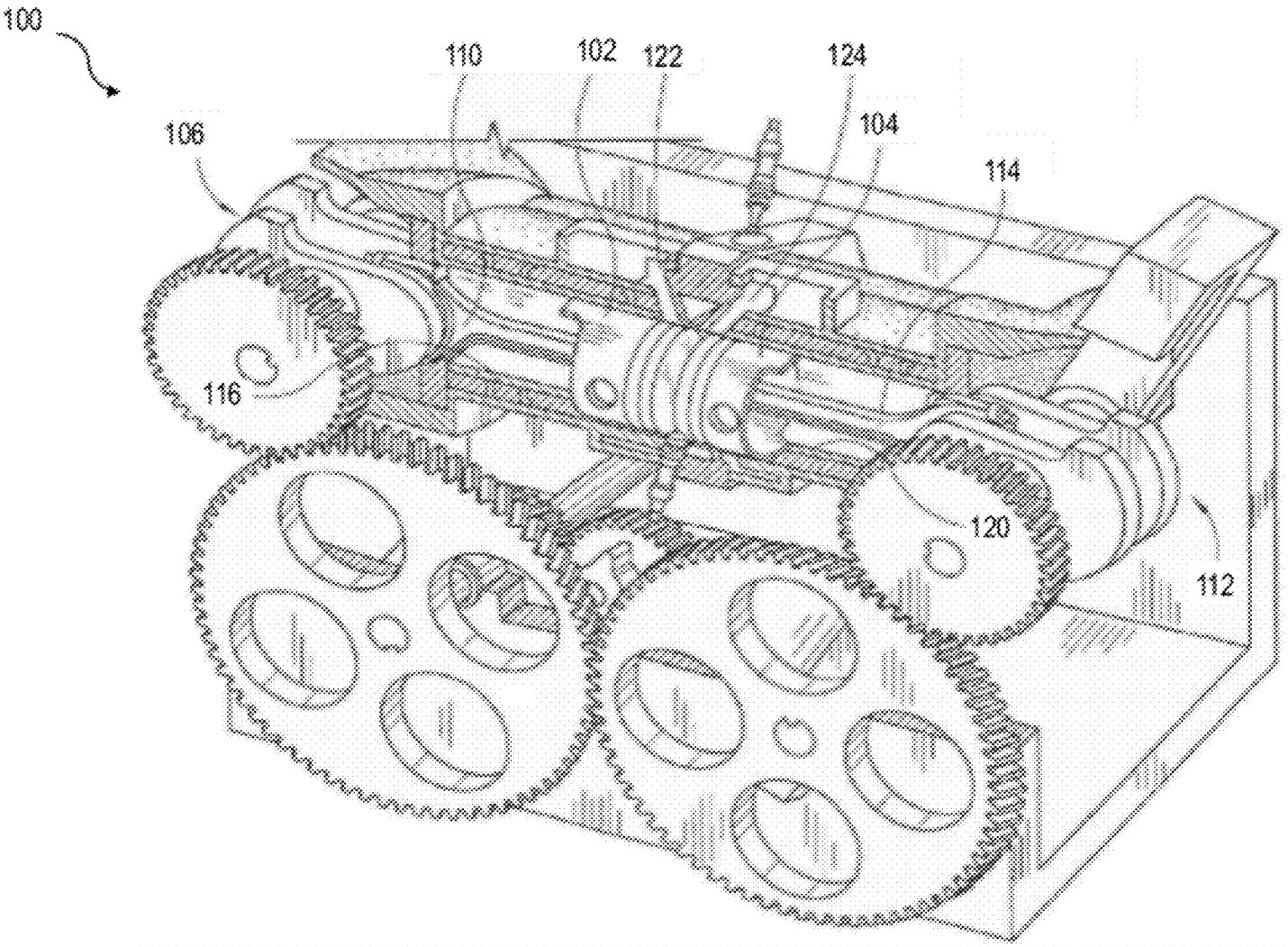
FIG. 1 shows a cutaway diagram of part of an internal combustion engine in which two opposed pistons move reciprocally within a cylinder.

FIG. 1 shows a partially cut away isometric view of an internal combustion engine 100 having a pair of opposing pistons that includes a first piston 102 and a second piston 104. The first piston 102 is operably coupled to a first crankshaft 106 by a first connecting rod 110 and the second piston 104 is operably coupled to a second crankshaft 112 by a second connecting rod 114. As shown in FIG. 1, the first crankshaft 106 is operably coupled to the second crankshaft 112 by a series of gears that synchronize or otherwise control motion of the first piston 102 and second piston 104. During engine operation, the first piston 102 and the second piston 104 reciprocate toward and away from each other in coaxially aligned cylindrical bores formed by corresponding sleeve valves. More specifically, the first piston 102 reciprocates back and forth in an exhaust sleeve valve 116, while the second piston 104 reciprocates back and forth in a corresponding intake sleeve valve 120. The exhaust sleeve valve 116 and the intake sleeve valve 120 can also reciprocate back and forth to open and close a corresponding exhaust port 122 and inlet port 124, respectively, at appropriate times during the engine cycle to deliver air and/or fuel to a combustion chamber 126 defined at least in part by the bodies of the exhaust and intake sleeve valves 116, 120 and the heads of the first and second pistons 102, 104.

Figure 2:
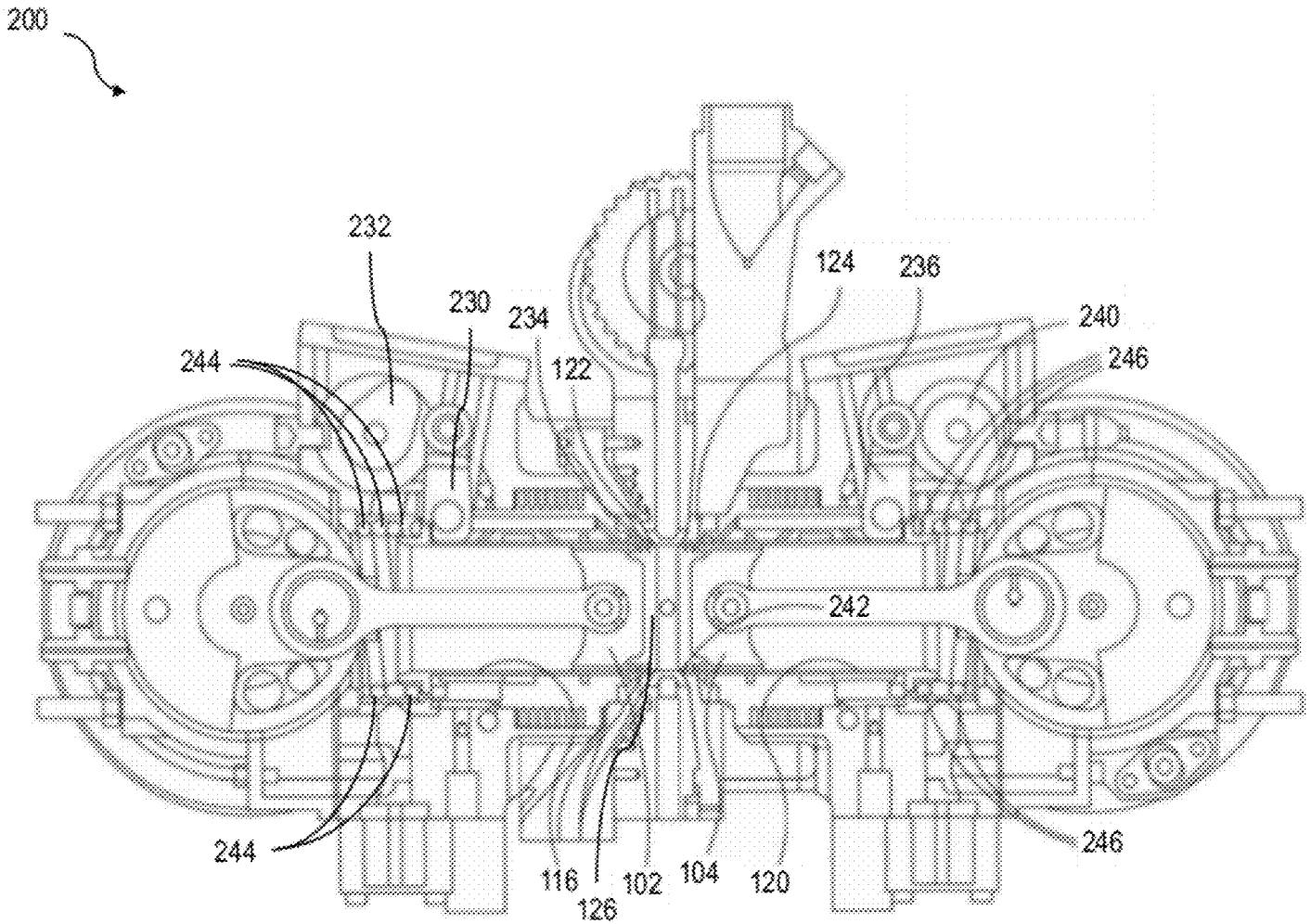
FIG. 2 shows a cross-sectional diagram of part of the internal combustion engine shown in FIG. 1.

FIG. 2 shows a cross-sectional view 200 of the internal combustion engine 100 of FIG. 1. As further illustrated in FIG. 2, a first pivoting rocker arm 230 (also referred to as a "rocker" 230), which has a proximal end portion in operational contact with a corresponding first cam lobe 232 and a distal end portion operably coupled to the exhaust sleeve valve 116, opens the exhaust sleeve valve 116, for example by moving a sealing edge of the exhaust sleeve valve 116 away from its corresponding first valve seat 234. Similarly, a pivoting rocker arm 236 (also referred to as a "rocker" 240), which has a proximal end portion in operational contact with a second cam lobe 240 and a distal end portion operably coupled to the intake sleeve valve 120, opens the intake sleeve valve 120, for example by moving a sealing edge of the intake sleeve valve 120 away from its corresponding second valve seat 242.

The first cam lobe 232 can be carried on a suitable first camshaft that can be operably coupled to a corresponding crankshaft by one or more gears. On the exhaust side, for example, rotation of the first cam lobe 232 can drive the proximal end portion of the first rocker 230 in one direction (e.g., from left to right), which in turn causes a distal end portion of the first rocker 230 to drive the exhaust sleeve valve 116 in an opposite direction (e.g., from right to left) to thereby open the exhaust port 122. A similar action can occur on the intake side, where rotation of the second cam lobe 240 can drive the proximal end portion of the second rocker 236 in one direction (e.g., from right to left), which in turn causes a distal end portion of the second rocker 236 to drive the intake sleeve valve 120 in an opposite direction (e.g., from left to right) to thereby open the inlet port 124.

Each of the exhaust sleeve valve 116 and the intake sleeve valve 120 is urged into a closed position by a corresponding biasing member, such as for example a first large coil spring 244 and a second large coil spring 246, each of which is compressed between a flange on the bottom portion of the corresponding sleeve valve and an opposing surface fixed to the corresponding crankcase. The first biasing member 244 urges the exhaust sleeve valve 116 from left to right to close the exhaust port 122 as controlled by the first cam lobe 232, and the second biasing member 246 urges the intake sleeve valve 120 from right to left to close the intake port 124 as controlled by the second cam lobe 240.

During operation of the engine 100, gas pressure acting directly on at least a portion of the annular sealing edges of the exhaust sleeve valve 116 and the intake sleeve valve 120, and also piston side loads resulting from the piston connecting rod angle relative to the cylinder axis, can tend to tilt or otherwise lift the exhaust sleeve valve 116 and the intake sleeve valve 120 off their respective first valve seat 234 and second valve seat 242, respectively. If the exhaust sleeve valve 116 and the intake sleeve valve 120 do not seal sufficiently, a number of undesirable consequences can result, including burnt valves, loss of power, poor fuel economy, accelerated wear, etc.

Figure 3:
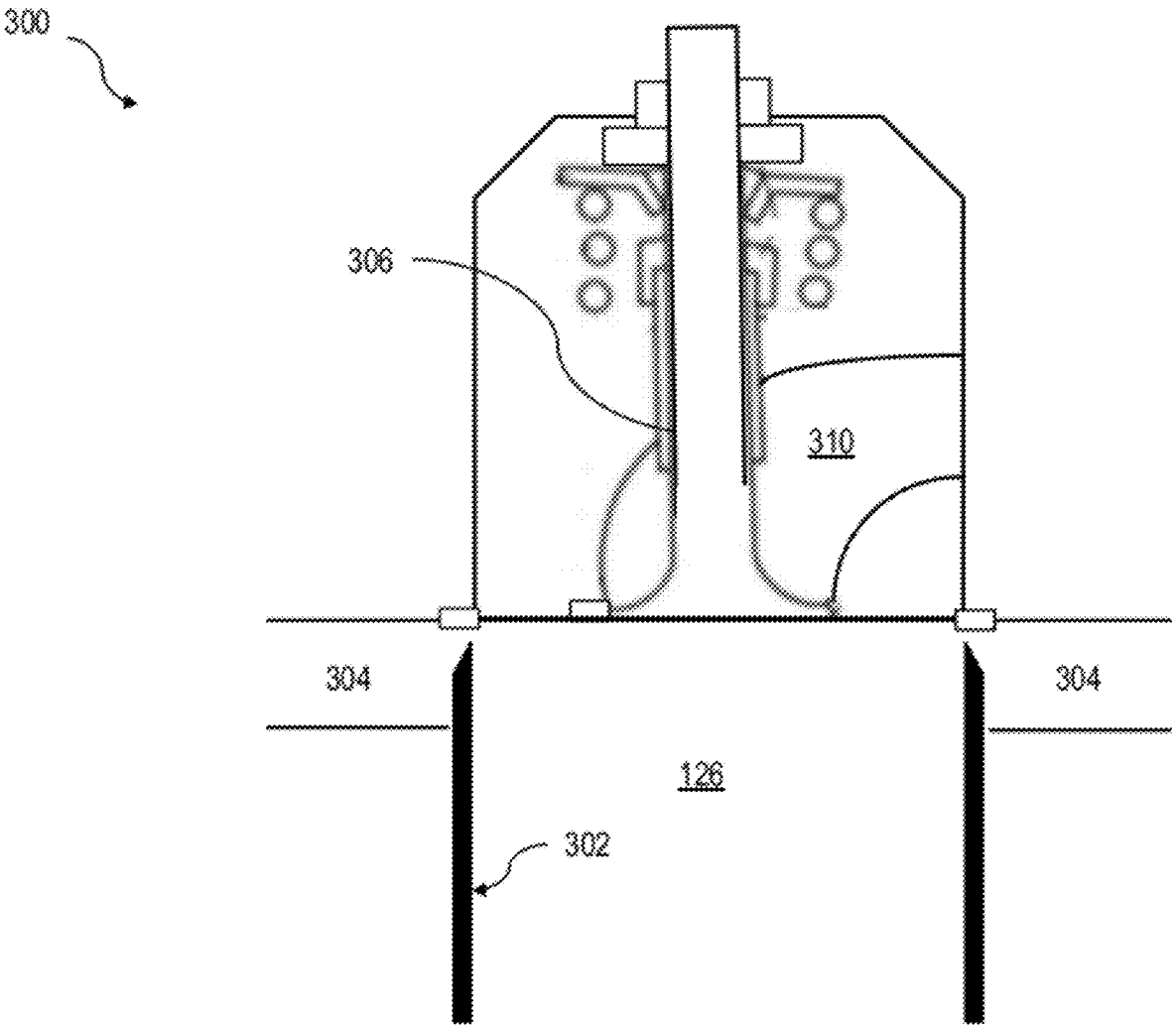
FIG. 3 shows a cross-sectional diagram of part of an internal combustion engine in which a single piston moves reciprocally in each cylinder and at least one of the intake and exhaust ports is opened and closed by a sleeve valve.

FIG. 3 shows an example of an engine 300 in a non-opposed piston configuration that nonetheless uses a sleeve valve 302 to open and close a first port 304, which can be either the exhaust port or the intake port. A poppet valve assembly 306 can control opening and closing of a second port 310, which can be the other of the exhaust or intake port that is not controlled by the sleeve valve 302. The single sleeve valve 302 can be controlled in a similar manner to that described above for the opposed piston engine. Also within the scope of the current subject matter are non-opposed piston engines that include dual sleeve valves, such as for example those described in co-pending and co-owned international patent application no. PCT/US2011/055457.

As described sleeve valves that undergo predominantly linear reciprocal motion along the piston axis of reciprocation can generally include a sealing edge that is urged into contact with a valve seat to form a seal. The sealing edge and the seat can in some examples have matching conically angled surfaces designed to overlap and mate when the sealing edge and the valve seat are brought into contact. However, at high gas pressures, this system must be properly designed to offset the tendency to leak. Unlike a poppet valve, in which gas pressure within a combustion chamber of the internal combustion engine tends to act on the valve head to force the tapered circumference of the valve head into the valve seat to assist in sealing, a sleeve valve experiences forces that push outward, and away from the seat, rather than augmenting forces generated by a valve actuation system to urge the sealing edge into the seat. In other words, gas pressure directly acting on the end of the sleeve valve as well as the side loads placed on the sleeve by the piston due to the force of the gas pressure on the piston and the rod angle relative to the cylinder axis can combine to tilt the sealing edge of the valve off of the valve seat. In some engines, a spring or springs acting substantially along the centerline of the cylinder can be used to overcome this tendency and to hold the sealing edge of the valve closed against the valve seat. The lever arm to resist upsetting moment induced by the rod angle typically increases as a function of increasing cylinder diameter. However, the upsetting force itself typically scales with the area of the piston (i.e. the square of the piston diameter). As such, larger bore engines can require a much larger spring leading to a lower natural frequency, which can limit the operating speed range for the engine.

Previously available approaches to this problem have made use of a hydraulic system to provide extra force to hold the valve securely against the seat. Without a hydraulic system to actuate the valves, the hold-closed mechanism can be costly to implement as a standalone feature. In another example described in co-owned U.S. Pat. No. 7,559,298, a tapered section at the seat end of the sleeve valve can allow for the gas pressure to help hold the sleeve firmly against the seat. However, use of a special shaping at the sealing edge of a sleeve valve and/or on the valve seat can add complexity to the design, which can increase the cost to manufacture the engine.

Several factors can be related to insuring that a sleeve valve seals properly. The gas pressure working on the top surface of the valve exposed to the combustion chamber can become a large force trying to push the valve open. Misalignment of the bore with the valve seat can also limit the maximum pressure before leaks occur. Stiffness and thickness of the valve material as well as the valve diameter also effect the ability to seal. Breaking the sharp edges of the valve tip can also cause the maximum pressure before leaking to be reduced.

While it is common for valves and valve seats to be ground at slightly different angles in the poppet valve case, the methodology can be slightly different in the sleeve valve case. Forces that cause the valve to lift off the seat and leak in the sleeve valve case generally must be reacted by the mechanism holding the valve against the seat.

The force required to hold the valve closed against the gas pressure can be determined by the width of the edge break on the tip of the valve combined with the width of the additional exposed area of the valve tip due to the bowing of the sleeve due to the gas pressure in the chamber. Additional force can be required to distort the sleeve to fit the seat if the bore that the sleeve slides in is offset relative to the seat. Additionally, the piston side loads can tend to tilt the sleeve off the seat. All of these forces need to be overcome by the mechanism used to hold the valve against the seat.

To address these and potentially other issues with currently available solutions, one or more implementations of the current subject matter provide methods, systems, articles of manufacture, and the like that may improve the sealing ability of sleeve valves in internal combustion engines.

One approach to the valve sealing challenges discussed above is to use a spring to force the valve against the seat. The spring can be sized so that at the closed position it has enough force to react against the forces listed above. However, the force needed to hold the valve closed and sealed can be significantly larger than the force needed to keep the cam-generated motion under control. As an example, for a 51 mm bore and a 0.25 mm edge break, the spring force needed is at least several times the force that would generally be designed in just to control the valve motion at traditional small production engine operating speeds (6000 rpm). The spring force required for obtaining a seal with matching angles can be higher than if there is an interference angle. The optimum interference angle, which can be characterized as the mismatch between the taper of the sealing edge of the sleeve valve 402 and the taper of the valve seat 404, can be determined by several factors including, but not necessarily limited to, the chamber pressure in comparison to a piston top ring position, the width of the edge break of the sealing edge of the valve, the thickness of the sleeve valve itself, the modulus of the sleeve valve material, the modulus of the seat material, the sleeve valve diameter, the angle of the valve seat, and the like.

Figure 4A:
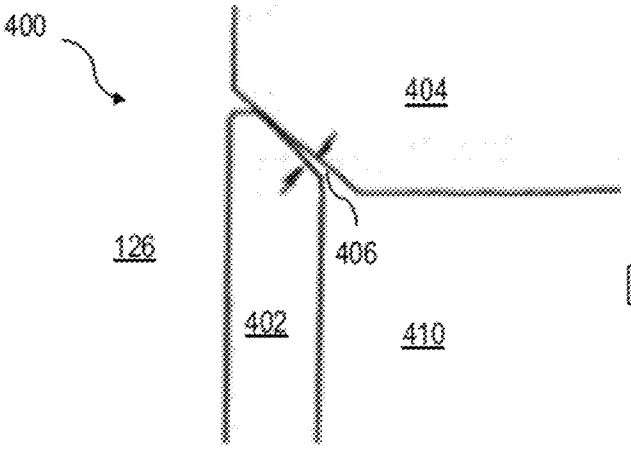
FIG. 4A, FIG. 4B, FIG. 4C, FIG. 4D, FIG. 4E, and FIG. 4F show cross-sectional diagrams illustrating effects of bowing on sleeve valve sealing.
Figure 4B:
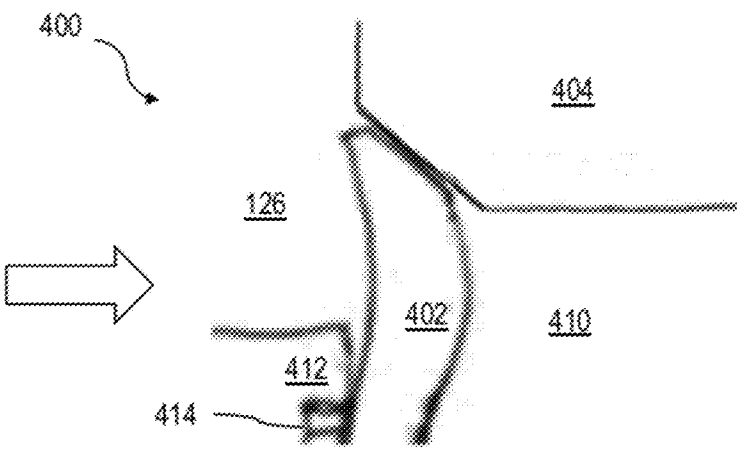

The series of FIG. 4A and FIG. 4B show sealing difficulties that can be encountered in an engine system 400 with deflection of a sleeve valve 402 in a radial direction while it is in contact with a valve seat 404. In FIG. 4A, the sleeve valve ground conical sealing edge of the sleeve valve 402 has made contact with the valve seat 404, which is ground at a slightly different angle from the sealing edge such that the taper of the valve sealing edge and the valve seat 404 are mismatched at approximately atmospheric pressure. Accordingly, a small gap 406 is present on the outside of the sleeve valve 402, which is exposed to the port volume 410. As the piston 412 moves toward the valve seat 404 during the compression stroke and subsequently in the expansion stroke after ignition of the combustion mixture contained within the combustion chamber 126, the pressures within the combustion mixture can cause the sleeve valve 402 to bow outward above the top piston ring 414 as shown in an exaggerated manner in FIG. 4B, which is not to scale. This bowing of the sleeve valve 402 can cause the gap 406 to now exist on the inner side of the sleeve valve 402 such that surfaces of the sealing edge of the sleeve valve experience the high pressures of the combustion chamber 126 acting in a direction opposing the force of the spring driving the sleeve valve 402 into contact with the valve seat 404.

Figure 4C:
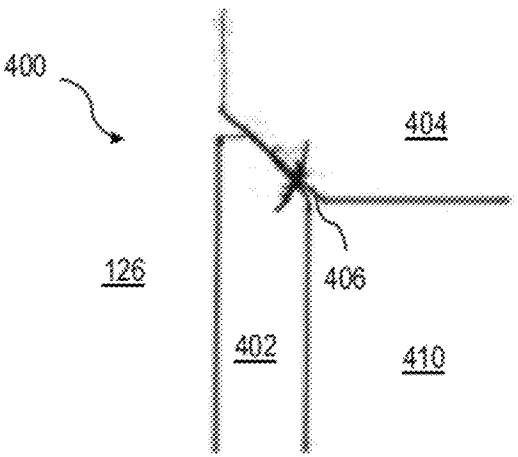
Figure 4D:
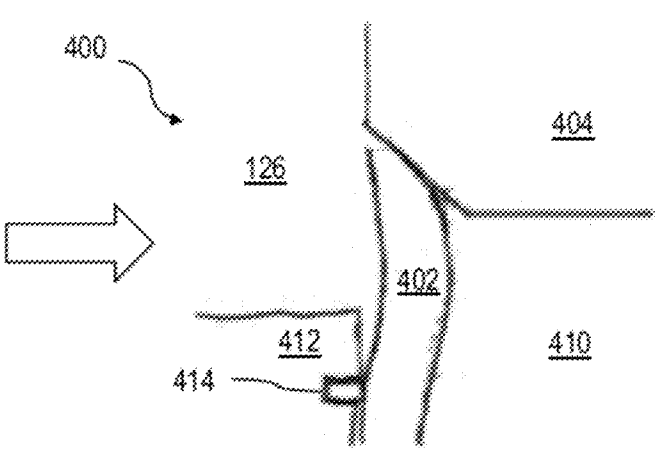

FIG. 4C and FIG. 4D illustrate features consistent with an implementation of the current subject matter in which the interference angle or mismatch between the taper of the sealing edge of the sleeve valve 402 and the taper of the valve seat 404 is based on a calculated maximum deflection of the sleeve valve due to the gas pressure bowing the sleeve valve 402 between the piston top ring 414 and the valve seat 404. The interference angle can be adjusted as shown in the series of FIG. 4C and FIG. 4D such that at maximum deflection, the inner edge (i.e. the edge exposed to the high pressure of the combustion chamber) of the tapered sealing edge of the sleeve valve 402 always stays in contact with the seat. The interference angle can advantageously not be any larger than necessary to insure the largest contact area between the sealing edge of the sleeve valve 402 and the valve seat 404 to provide maximum cooling. Once the interference angle is defined, the spring can be sized to insure the gas pressure on the edge break of the sealing edge does not cause the sleeve valve 402 to lift off the valve seat 404. The bore sizing for the block and the positioning of the cylinder bore can advantageously be determined such that the sleeve valve 402 can sit on the valve seat 404 such that the valve centerline is perpendicular to the plane of the valve seat 404, without contacting the block sidewall. Interference angles of greater than approximately 1° can be advantageous for thin flexible valves. Interference angles in a range of approximately 0° to 1° can be used for stiffer valves. An advantageous valve thickness and material can be determined based on a relationship between peak pressures, cylinder diameter, and hold closed force needed.

Figure 4F:
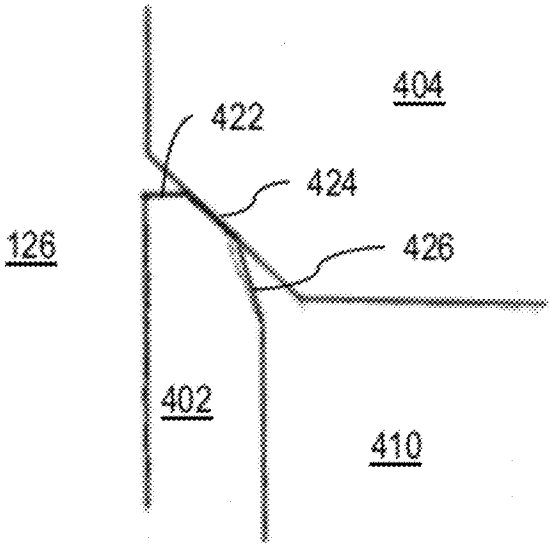
Figure 4E:
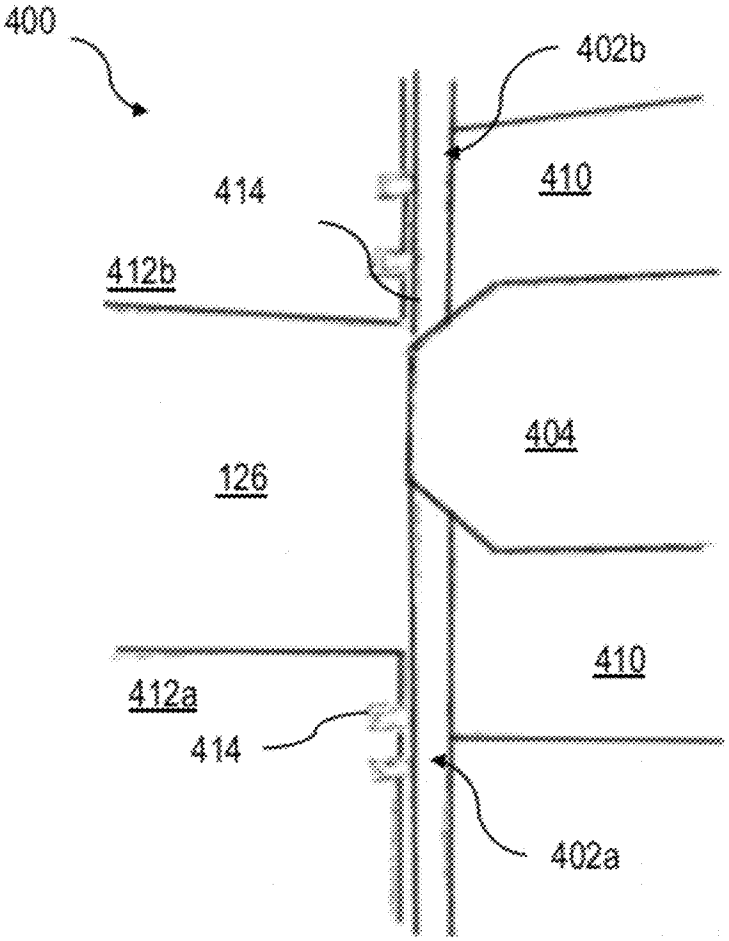

FIG. 4E shows potential impacts of using out of phase piston motion to provide a variable compression ratio in an opposed piston engine. A leading piston 412*a* can reach a top dead center position in the combustion chamber 126 earlier than a trailing piston 412*b* and being moving back toward bottom dead center prior to ignition, which can be timed to occur closer to the trailing piston reaching its top dead center position. Accordingly, the leading piston 412*a* can allow more of a first sleeve valve 402*a* to be exposed to the high combustion pressure of the combustion chamber 126 than the trailing piston 412*b* allows exposure of a second sleeve valve 402*b*. In this case the interference angle can advantageously be larger for the first sleeve valve 402*a*, which is subject to a greater degree of bending because a greater surface area of the first valve experiences the peak combustion pressure in the combustion chamber 126.

A similar effect can occur for a variable compression opposed piston engine in which the variable compression ratio is provided by connecting one of the opposed pistons to a crankshaft that can be translated along its associated piston's axis of reciprocation to vary the location of that piston's top dead center position. In this example, the view of FIG. 4E occurs at top dead center for both pistons at the maximum current compression of the engine. The effect is most pronounced when the engine is operating in a lower compression ratio configuration, as the translatable crankshaft, and consequently the top dead center position of the secondary piston, would be translated as far as possible from the center of the engine.

FIG. 4F shows a sealing edge of a sleeve valve 402 with multiple angles. One angle 422 can effectively "trim off" an otherwise sharp edge of the sealing edge to eliminate overly rapid heating of that portion of the sleeve valve 402. A second, next angle 424 can be matched to the valve seat angle and can advantageously have the interference angle included. A third angle 426 can be a relief angle that is much steeper than the sleeve valve 402 contact angle, so that as the sleeve valve 402 and the valve seat 404 wear, the sleeve valve 402 never bows so much that the valve 402 contacts the seat 404 out in the relief region. In this way as the system wears, the pivot about which the sleeve valve 402 bows does not move out to allow excessive pressure to build on top of the valve where it can act in opposition to the spring force holding the sleeve valve 402 closed.

In other examples, the interference angle can change with the valve seat angle. If a shallow 30° angle is chosen to enhance the flow coefficient through the valve opening, the friction between the valve and the seat can, in some instances, not be high enough to keep the valve tip from expanding due to the gas loads. This deficit can cause the resultant angle between the valve and seat to be different. In general, this type of bowing can insure that the inner edge stays in contact.

Shallow angles and insufficient force or friction can allow the valve to slide across the seat face as it expands under pressure. In one way this effect can enhance the wear rate of the components. In another way, however, the scraping action can help minimize deposit build up and can in some instances actually enhance the ability to seal over the life of the valve.

In another implementation, a sleeve valve reverse angle seal profile can be provided. Using a conical section or a section of some other tapering solid of rotation at the tip of a sleeve valve can aid in valve location and sealing. However, end surfaces of the valve exposed to combustion gases can tend to force the valve open. Changing the geometry of the valve tip seal as discussed below can lower the hold-closed force required.

FIG. 5A shows a section view of a valve tip geometry of two sleeve valves 402*a*, 402*b* in an opposed piston engine 500 having a 45-degree conical or other tapering solid of rotation seal surface with a valve seat 404. A similar valve tip or sealing edge geometry can also be used in engines other than opposed piston engines. The axis of the cones or other tapering solids of rotation defining the first and second sealing surfaces for the two sleeve valves 402 is equivalent to the central axis of the valve 502 and the axis of motion of the piston. The apex of each of the cones or other tapering solids of rotation is directed toward the closed position of the respective valve, or in other words toward the center of the engine (e.g. toward the location of closest piston approach at top dead center) with the bases facing each respective crankshaft. The shown conical or other tapering solid of rotation section can be effective for sealing (as can angles of conical seal surfaces other than 45°). However, a portion of a flat sealing edge surface 504 of each sleeve valve 402 is exposed to combustion gas pressures within the combustion chamber 126, which tends to drive each of the valves open. The exposed area can be minimized by adding a slight interference between the two, causing the surfaces to meet at the inner region of the seal surface, but the exposed valve area cannot be reduced to zero without introducing an unfeasibly sharp edge.

However, as shown in the engine 500 of FIG. 5B, reversing the cone or other tapering solid of rotation geometry for each sleeve valve 402 with a small interference angle can reduce the need for an edge break in the combustion region because the inside tip angle can be oblique, for example 135 degrees instead of 45 degrees. In this example, the apex of the cone or tapered solid of rotation is oriented toward the open position of each sleeve valve, or in other words toward each piston's respective crankshaft. With the application of an interference angle biasing contact toward the interior edge of the valve sealing surface, the valve top area 504 exposed to gases can be substantially minimized. The sealing surface can in some implementations be reduced to a 45-degree edge break on a mostly square-topped valve, which can reduce port interferences from the valve seat sealing lip. The excess area exposed to the combustion gases can be part of the valve seat, and can therefore result in no net force applied to the valve. FIG. 5C and FIG. 5D show additional engine configurations 500 including illustrative examples of alternative configurations consistent with this implementation.

Figure 6A:
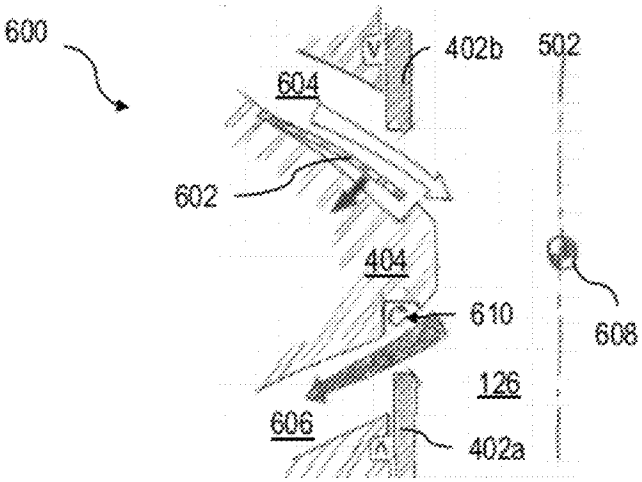
FIG. 6A, FIG. 6B, FIG. 6C, and FIG. 6D show cross-sectional diagrams illustrating features of sealing-enhanced sleeve valves.

The "stepped" seat surface that results from a valve seat configuration as discussed in reference to FIG. 5 can potentially be disruptive to port flow. One possible configuration for correcting inlet flow is to use a springy or resilient flow smoother 602 as shown in the example systems 600 of FIG. 6A, FIG. 6B, FIG. 6C, and FIG. 6D. As shown in FIG. 6A, a flow smoother 602 can be pushed into a retracted position as the sleeve valve 402*a* closes, and rebound to smooth inlet flow as the sleeve valve 402*a* opens. The ports 604, 606 can be designed so that the natural flow lines of the port flows smoothly with the seat angle, in a "negative angle approach", particularly with so-called tumble ports (for example as described in co-pending and co-owned international patent application no. PCT/US2010/046095) in which the port approach is principally from one direction as shown in FIG. 6A.

Figure 6B:
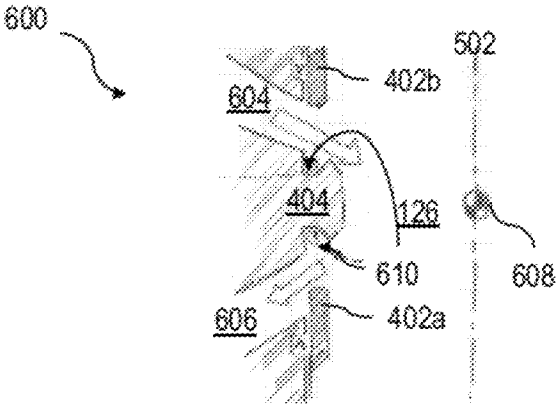
Figure 6C:
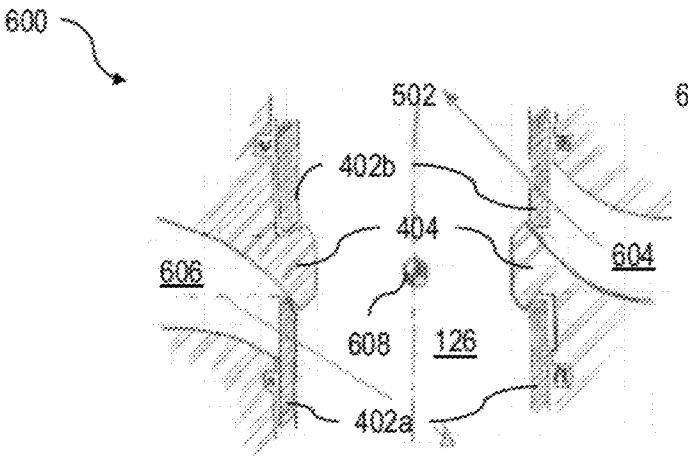
Figure 6D:
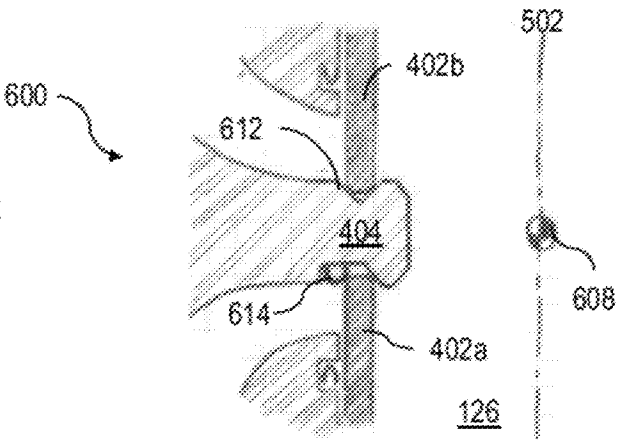

The port-directed fluid flow path of the configuration shown in FIG. 6A generally directs the main direction of fluid flow away from the engine center 608, which can potentially generate undesirable flow coefficients under some conditions. With ports maintaining a "positive angle" approach, where the main flow line of the port points toward engine center, the valve pockets can be sized so that a low-drag recirculation pocket 610 can form in the valve seat 404 without disturbing the bulk flow. Examples of positive angle approach ports are shown in FIG. 6A and FIG. 6B. FIG. 6D shows a spring-biased intake flow, recirculation trap exhaust port configuration consistent with implementations of the current subject matter. The outer edges of the sleeve valves can optionally have their sharp edges broken, in contrast to the unbroken edges shown in the figures. This softening can have an additional benefit related to deformations of the sleeve valve under gas pressure. The valve can stretch under hoop stress to some extent, but the valve spring can still push it back in place. If valve spring force is insufficient, however, a taper on the outside of the seal can be used to wedge against another angle feature 612 in the valve seat to resist the hoop stress. For example, a second conically or other tapering solid of rotation angled surface 612 can be formed on the valve seat with a conical or other tapering solid of rotation angle biased back toward the interior of the combustion chamber 126. The inside edge of the sleeve valve 402*b* can seal against the reversed cone or other tapering solid of rotation geometry of the valve seat 404 while the outside edge biased against the second conically or other tapering solid of rotation angled surface can further assist in resist bowing of the sealing edge of the sleeve valve 402*b*. A corrective "wedging" action can in some implementations be achieved by a press-in spring element 614, to make a slightly softer resistance with a lower risk of compromising the gas seal. A spring insert 614 can be added as part of the valve seat 404 to bias the sealing edge of the sleeve valve 402*a* against the conical or other tapering solid of rotation section of the valve seat.

Another implementation of the current subject matter provides various features relating to double-wall gas-assisted sleeve valves. As noted above, the valve seal can be a critical component in a reciprocating sleeve valve engine. Oil leaking past the seal can alter the combustion charge properties and directly contribute to emissions. Reducing the temperature of the sleeve surface in contact with the seal can be beneficial. Accordingly, consistent with some implementations, an "umbrella" valve, in which a tip of the valve has a double wall and the surface against which the valve oil seal rides is directly cooled, can be used.

Reducing the gas loads attempting to push the valve open can also be beneficial, as this can lead to better sealing with lower valve spring forces. A lipped valve design can be used, in which cylinder pressures enhance the valve contact force, rather than detract from it. An issue with an umbrella sleeve can be the complexity of manufacture, and an issue with the lipped valve can be properly honing the cylinder with the lip in the way. A double-wall valve concept as discussed herein can reconcile both issues by assembling a composite valve of two or three components with a furnace braze.

Figure 7B:
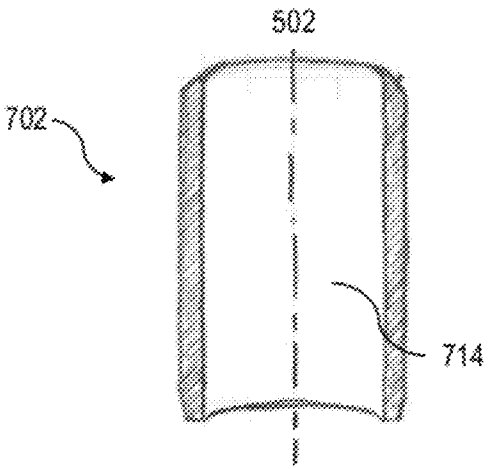
FIG. 7A, FIG. 7B, and FIG. 7C show cross-sectional and cutaway diagrams illustrating features of double-wall gas-assisted sleeve valves.
Figure 7A:
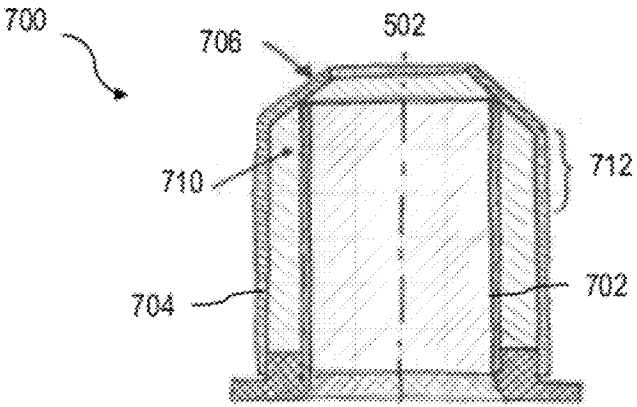

An example of such a valve is shown in FIG. 7A, which is not necessarily to scale or shown with a proper aspect ratio. A valve 700 can include an inner body 702 and an outer body 704. The inner body 702 can function as the cylinder surface, thereby providing a running surface for the piston that reciprocates within the sleeve valve. The outer body 704 can act as the sealing surface, and can form a gas pressure lip 706, an outer wall of a cooling cavity 710 formed between the inner body 702 and the outer body 704, and a seal running area 712 that interacts with sealing rings between the valve and the engine body.

The inner body 702 can optionally include a tube section as shown in FIG. 7B and can be shaped and stress relieved such that it can go undergo thermal cycling without residual distortions. The component forming the inner body 702 can optionally be cut to length, formed, and stress relieved as necessary to a near net shape, and honed on its inner surface 714. Operations used in forming the inner body 702 can include grinding and forming operations.

Figure 7C:
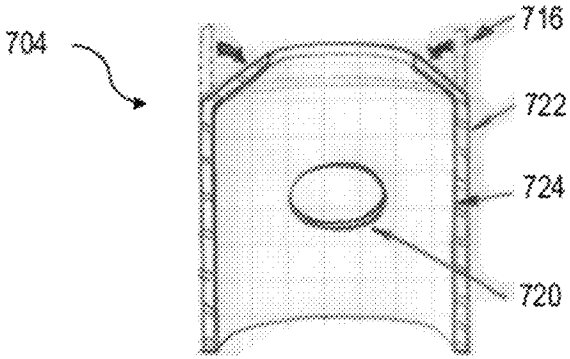

The outer body 704 can also include a tube section as shown in FIG. 7C. The outer body tube section can undergo a forming operation to produce an angled lip 716 on one end, and a square cut to length on the opposite end. Inlet and outlet ports 720 for the cooling fluid can be added by punch, stamp, or cutting process. The outer surface 722 of the cylindrical body can be ground to provide a good running surface, which the inner surface 724 of the outer body 704 need not be as well honed due to its lack of interaction with other surfaces. Again, the piece can advantageously be thermally stable and at a good running shape.

Figure 8:
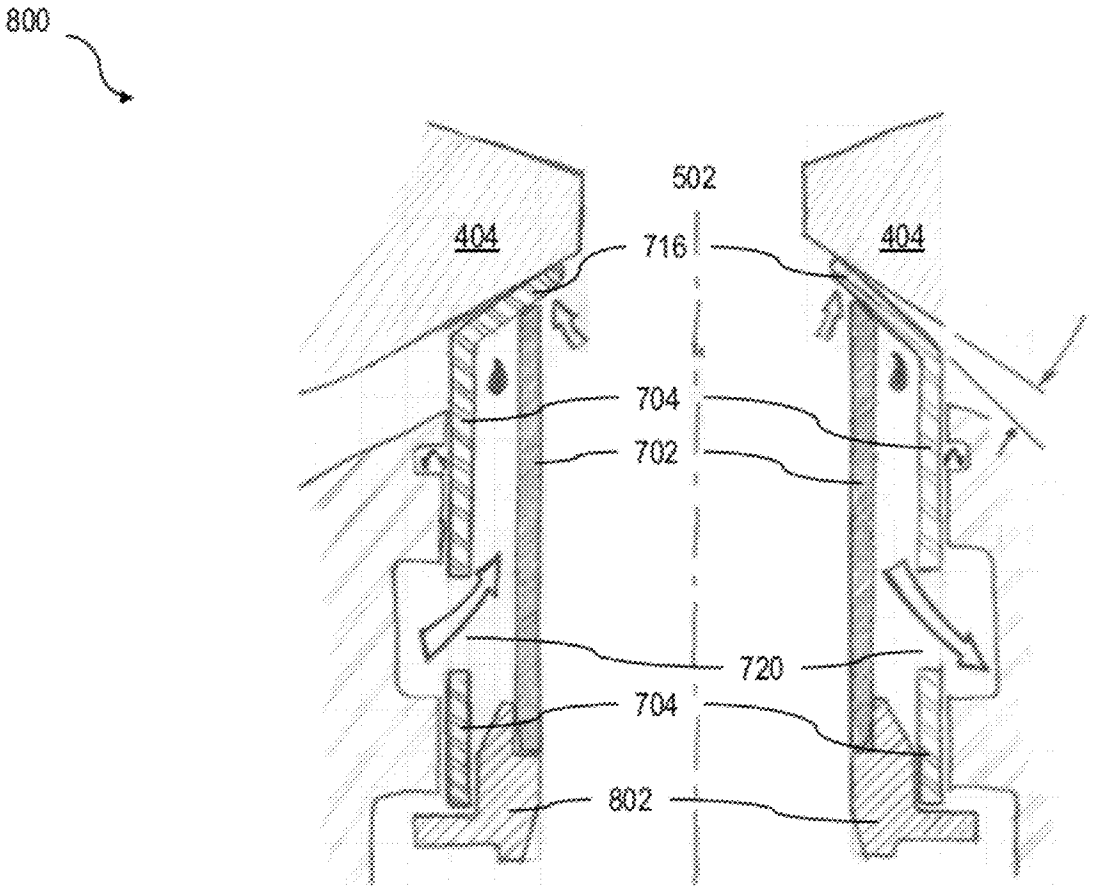
FIG. 8 shows a cross-sectional diagram illustrating features of a double-wall gas-assisted sleeve valve.

An example of an assembled double-wall gas-assisted sleeve valve in an engine 800 is shown in FIG. 8. The inner body 702 and outer body can be assembled with a bottom anchor ring 802, and placed in a furnace braze process. Thermal distortion under the furnace braze can advantageously be as small as possible to retain the good form of the brazing. Other candidates for joining the two bodies can include, but are not limited to, electron beam or inertia welding, solder, and possibly even high performance adhesives. FIG. 8 also shows additional detail regarding the an angled lip 716, which can protrude inward past the inner surface of the inner body 702 to provide a surface that receives the high combustion chamber pressures directed in manner that assists in urging the valve against the valve seat 404.

As opposed piston engines are typically installed with the cylinder axis (axis of piston reciprocation) horizontal, one possible configuration of a valve cooling supply is to position an oil squirt jet 902 on the top of the sleeve valve, and a drain pocket 904 at the bottom as shown in the valve body 900 of FIG. 9A. Oil can be injected into the cooling jacket formed between an inner valve body 702 and an outer valve body 704 as discussed above, splashed around, and drained out. It may be necessary to place several cooling fluid vents around the perimeter of the valve, with one or multiple jets, to maintain a consistent flow of cooling fluid. One approach to providing multiple cooling fluid vents in the outer valve jacket is to form longitudinal "gills" 906 in the outer body 704 as shown in FIG. 9B. These features can provide a vent surface and also add stiffness to the outer body 704. Another approach that can stiffen a cooling port is to place a circular dimple 910 around an elliptical port 912, in what can be described as a "cat's eye" port, such as the example shown in FIG. 9C. Two rows of alternating ports 914 can be positioned around the perimeter of the outer body 704 as shown in FIG. 9D to improve cooling filling. If the port areas of the alternating ports 914 overlap, then a port can be available somewhere during the valve stroke at any point, whether during the valve opening or the valve closing.

Figure 10:
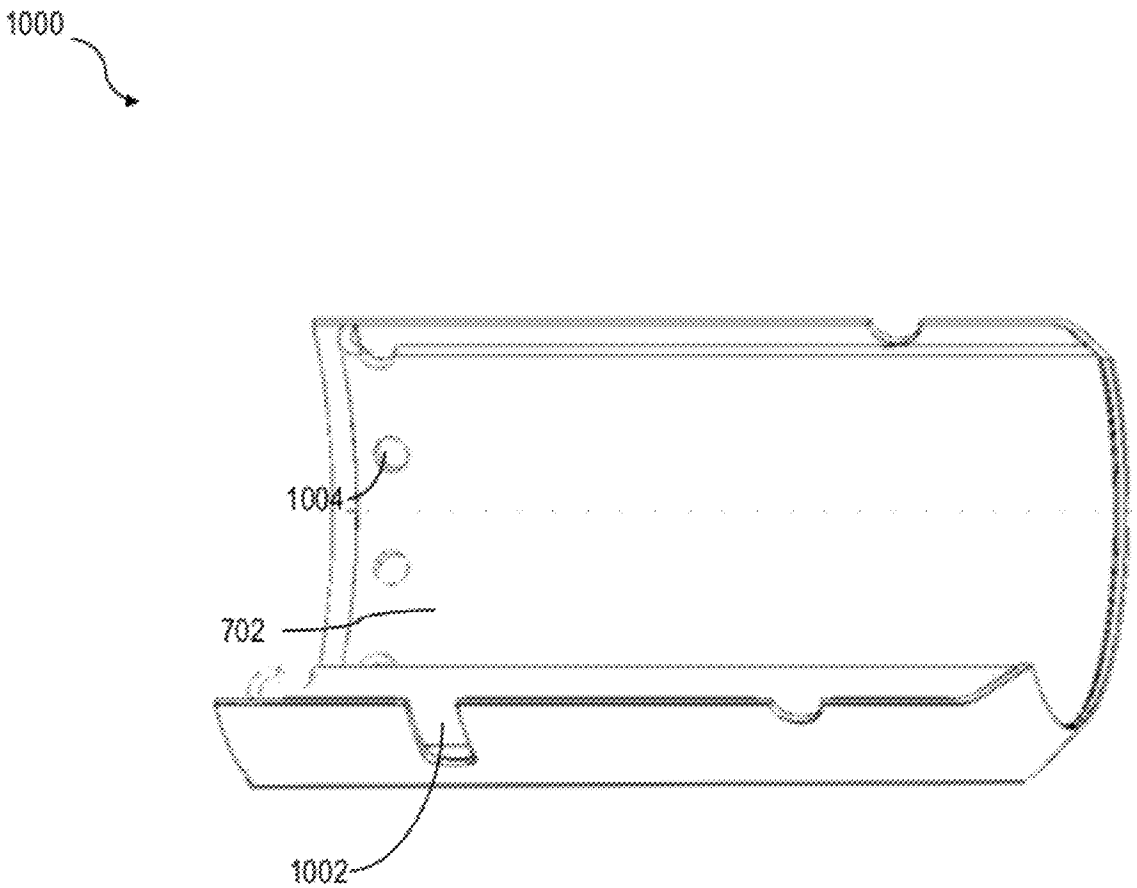
FIG. 10 shows a cutaway diagram illustrating features of a sleeve valve.

It can also be possible to construct this style of valve of only two components, provided that tolerances are held sufficiently tight. If the lower lip of the inner body is formed, trimmed, and heat relieved prior to a honing operation, sufficient tolerances can be maintained. The outward-formed flange of the inner body 702 can also be extended past the outer body, as a flange upon which the valve rocker might act. The rocker can act on the valve 1000 shown in FIG. 10 by engaging a pair of slots 1002, one of which is visible in the view of FIG. 10. This scheme can provide advantages in restraining the rotation of valve somewhat, so that a cooling jet can always be pointed into the valve. FIG. 10 also shows a further set of cooling fill/drain holes 1004 at the bottom of the inner body that can optionally be included.

In one or more implementations, a two-component sleeve does not require an air gap/coolant gap. If the internal body is sufficiently stiffer than an outer body, it can be ground and honed prior to the outer body being pressed over it. The outer body lip provides a gas assist feature upon which the combustion chamber pressures act to further urge the sleeve valve against the valve seat, and the inner body provides hoop strength and shape. The fit between the two bodies can resist the gas trying to push the inner body out of outer body. The joint between the inner and outer bodies can be shaped to minimize both the separation force and the crevice volume. The press to resist separation can apply to a valve with an air/coolant gap as shown in FIG. 7 through FIG. 10 and also to a valve with no such gap.

In another implementation, piston-style rings can be used to seal sleeve valves. As noted above, the valve seal can be a critical component in a reciprocating sleeve valve engine. Oil leaking past the seal can alter the combustion charge properties and directly contribute to emissions. Further, the seal generally operates in a hot, harsh environment, in contact with the hottest portion of the sleeve valve. Performance of the seal can therefore be critical, and the exposure to heat can prevent the use of polymer lip seals.

Conventional piston rings typically have the benefit of higher thermal conductivity and higher temperature tolerance than polymer lip seals. By their conduction, they can also decrease peak sleeve valve temperatures by conducting energy away from the valve at points where there is no conduction through a polymer seal. However, the end gap can be problematic in a valve sealing application, as oil may leak through directly.

Figure 11B:
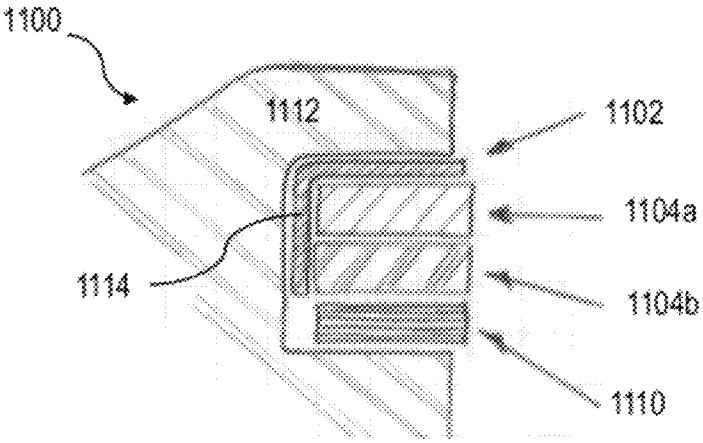
FIG. 11A, FIG. 11B, and FIG. 11C show isometric and cross-sectional diagrams illustrating features of a sleeve valve sealing approach.
Figure 11C:
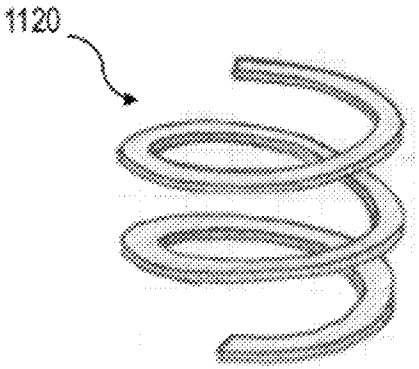
Figure 11A:
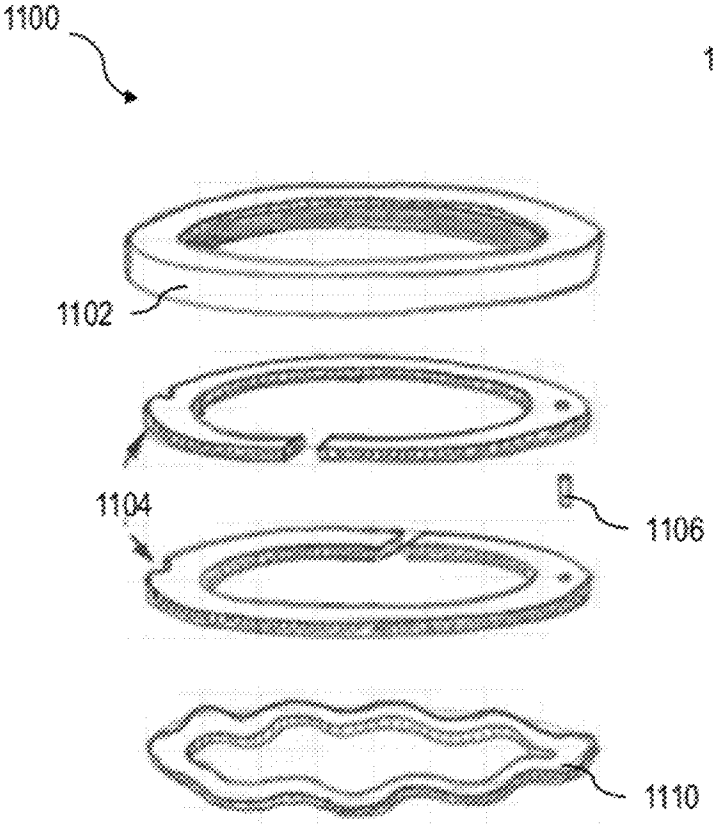

Implementations of the current subject matter can include a stack of sealing elements assemble to form a usable seal 1100 as shown in FIG. 11A. A sandwich structure can be created, with the top layer 1102 being a thin shell of high temperature polymer in a flat circle, with an inner diameter just larger than the outer diameter of the sleeve valve. The middle layer can include a pair of indexed piston rings 1104, with parallel top and bottom faces, and an indexing feature 1106 such that the end gaps do not align. Advantageously, the indexing feature 1106 can be symmetric such that a single part can be used for both or the pair of rings 1104. The bottom layer 1110 can include a wave spring, similar to a spacer spring in a conventional oil control ring, which pushes the stack together.

The sealing against the valve can be principally performed by the lower scraping ring as shown in FIG. 11B. The end gap in the lower ring 1104*b* of the pair of piston rings can be covered by the upper sealing ring 1104*a* of the pair. The upper sealing ring 1104*a* can be pushed against the polymer seal 1102, which can seal between the upper sealing ring 1104*a* and the seal stack retaining body 1112. The polymer seal 1102 can also have a skirt 1114 around its outer perimeter, to seal against the outer diameter of the upper sealing ring 1104*a*. This skirt function can also be performed by a separate flexible polymer piece. The skirt 1114 can also have the function of increasing the ring tension against the valve surface.

This approach can require the outer diameter of the valve to be honed, so that oil retention is sufficient to run the seal rings without undue wear. Also, a seal that operates in the opposite fashion from a piston ring can be necessary. A piston ring can be compressed to push outward and seal on the outer surface. The valve seal ring can be stretched to pull inward and seal on the inward surface. The manufacturing process for such a ring can differ from that of a standard ring. Another approach is a greater-than-one-turn coil of similar scraping cross section 1120 as shown in FIG. 11C. This configuration can effectively scrape the complete surface of the valve, avoiding the end gap issue, but can require a circumferential polymer seal, as it presents no flat face for easy sealing.

Figure 12:
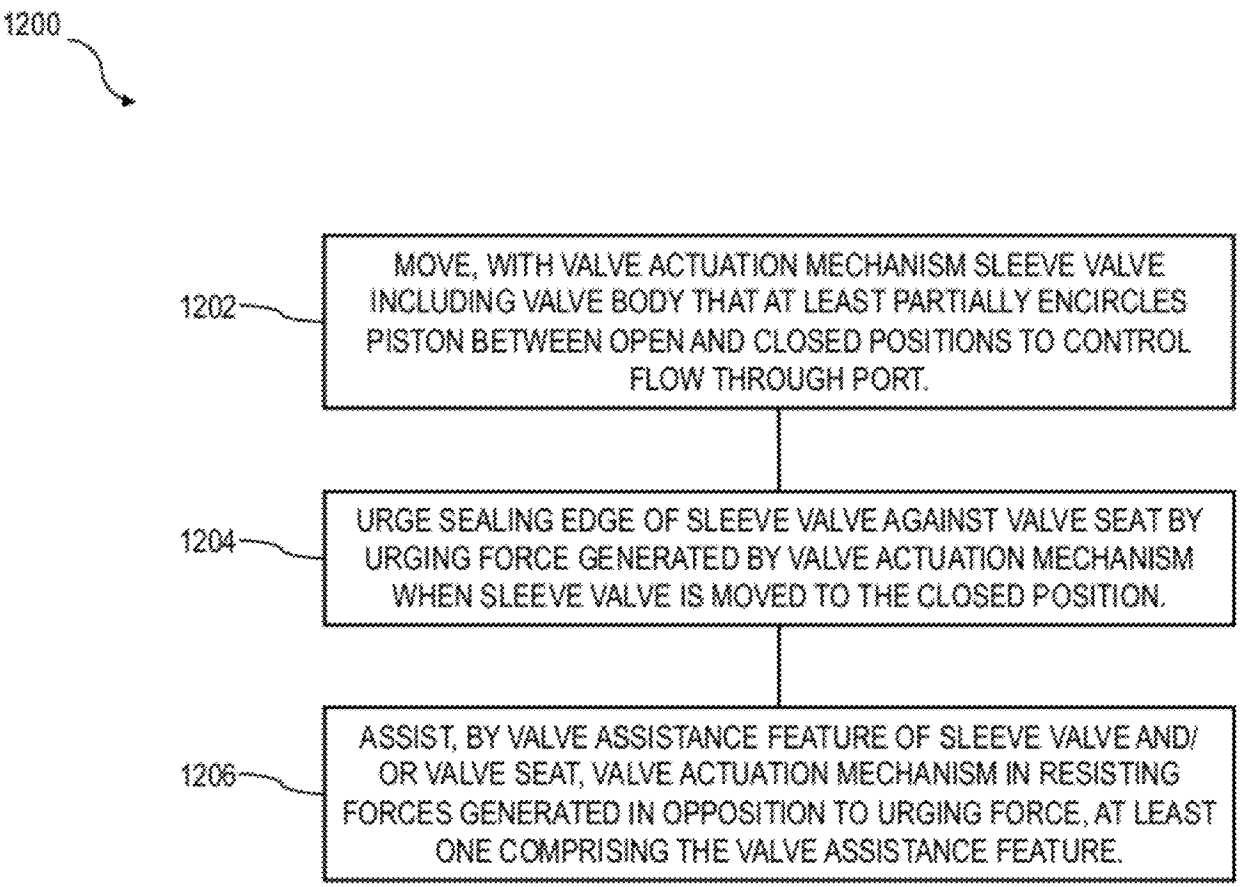
FIG. 12 is a process flow diagram illustrating aspects of a method having one or more features consistent with implementations of the current subject matter.

FIG. 12 shows a process flow chart 1200 illustrating method features consistent with one or more implementations of the current subject matter. At 1202, a sleeve valve is moved by a valve actuation mechanism between an open position and a closed position to control flow through a port of an internal combustion engine. The sleeve valve includes a valve body that at least partially encircles at least one piston that moves in a reciprocating manner. The sleeve valve and the at least one piston at least partially define a combustion chamber of the internal combustion engine. At 1204, the sealing edge of the sleeve valve is urged against a valve seat by an urging force generated by the valve actuation mechanism when the sleeve valve is moved to the closed position. A valve assistance feature assists the valve actuation mechanism in resisting forces generated by the internal combustion engine in opposition to the urging force at 1206. At least one of the sleeve valve and the valve seat include the valve assistance feature. The forces generated by the internal combustion engine in opposition to the urging force can include a pressure of combustion gases in the combustion chamber acting on an exposed surface of the sealing edge in a direction counter to a valve closing force of the valve actuation mechanism.

The implementations set forth in the foregoing description do not represent all implementations consistent with the subject matter described herein. Instead, they are merely some examples consistent with aspects related to the described subject matter. Although a few variations have been described in detail herein, other modifications or additions are possible. In particular, further features and/or variations can be provided in addition to those set forth herein. For example, the implementations described above can be directed to various combinations and sub-combinations of the disclosed features and/or combinations and sub-combinations of one or more features further to those disclosed herein. In addition, the logic flows depicted in the accompanying figures and/or described herein do not necessarily require the particular order shown, or sequential order, to achieve desirable results. The scope of the following claims may include other implementations or embodiments.

What is claimed is:

1. A system comprising:

a sleeve valve comprising a valve body that at least partially encircles at least one piston that moves in a reciprocating manner, the sleeve valve and the at least one piston at least partially defining a combustion chamber of an internal combustion engine;

a valve actuation mechanism that moves the sleeve valve between an open position and a closed position to control flow through a port of the internal combustion engine; and a valve seat against which a sealing edge of the sleeve valve is urged by an urging force generated by the valve actuation mechanism when the sleeve valve is moved to the closed position, the sealing edge directly contacting the valve seat in the closed position, and at least one of the sleeve valve and the valve seat comprising a valve assistance feature that assists the valve actuation mechanism in resisting forces generated by the internal combustion engine in opposition to the urging force, the forces generated by the internal combustion engine in opposition to the urging force comprising a pressure of combustion gases in the combustion chamber acting on an exposed surface of the sealing edge in a direction counter to a valve closing force of the valve actuation mechanism.

2. A system as in claim 1, wherein the valve actuation mechanism comprises a spring sized to ensure that the maximum gas pressure cannot lift the sealing edge off of the valve seat.

3. A system as in claim 1 wherein the interference angle is formed between a first sealing surface on the sealing edge and a second sealing surface on the valve seat, the first sealing surface being shaped like a first section of a first tapering solid of rotation having a first apex toward which the first sealing surface tapers, the second sealing surface being shaped like a second section of a second tapering solid of rotation having a second apex toward which the second sealing surface tapers, the first tapering solid of rotation and the second tapering of rotation each sharing their axes of rotation with a central axis of the combustion chamber.

4. A system as in claim 3, wherein the first tapering solid of rotation comprises a first cone and the second tapering solid of rotation comprises a second cone.

5. A system as in claim 3, wherein the first apex and the second apex are both oriented toward the closed position, or wherein the first apex and the second apex are both oriented toward the open position.

6. A system as in claim 1, further comprising an oblique interference angle between the first sealing surface and the second sealing surface.

7. A system as in claim 1, wherein the interference angle is based on a calculated maximum deflection of the sleeve valve due to a maximum pressure of the combustion gases in the combustion chamber, the interference angle causing an inner edge of the sealing edge to remain in contact with the valve seat even at the maximum deflection.

8. A system as in claim 1, wherein the internal combustion engine comprises an opposed piston engine, wherein the at least one piston comprises a leading piston at least partially encircled by the valve body and a trailing piston at least partially encircled by a second valve body of a second valve body of a second sleeve valve, the leading piston and the second piston reciprocating between respective top dead and bottom dead center positions in an out of phase member manner such that the leading piston reaches its top dead center position prior to the trailing piston reaching its top dead center position to provide a variable compression ratio capability, the second sleeve valve comprising a second sealing edge that is urged against a second valve seat, and a second interference angle between the second sealing edge of the second sleeve valve and the second valve seat being smaller than the interference angle.

9. A system as in claim 1, wherein the internal combustion engine comprises an opposed piston engine, wherein the at least one piston comprises a primary piston at least partially encircled by the valve body and a secondary piston at least partially encircled by a second valve body of a second sleeve valve, the primary piston and the secondary piston reciprocating between respective top dead center and bottom dead center positions on respective first and second crankshafts, the second crankshaft being translatable along an axis of motion of the secondary piston such that the secondary piston in a lower compression ratio configuration has a top dead center position further from a center of the engine than the primary piston, the second sleeve valve comprising a second sealing edge that is urged against a second valve seat, and a second interference angle between the second sealing edge of the second sleeve valve and the second valve seat being larger than the interference angle.

10. A system as in claim 1, wherein the sealing edge comprises a plurality of angles, the plurality of angles including a first angle that softens or trims off an otherwise sharp edge of the sealing edge to eliminate overly rapid heating, a second matched to an angle of the valve seat and including the interference angle, and a third, relief angle that is substantially steeper than a sleeve valve contact angle with the valve seat so that as the sleeve valve and the valve seat wear, the sleeve valve cannot bow so much that the sealing edge and the valve seat make contact in the third, relief region.

11. A method comprising: moving a sleeve valve between an open position and a closed position to control flow through a port of an internal combustion engine, the sleeve valve comprising a valve body that at least partially encircles at least one piston that moves in a reciprocating manner, the sleeve valve and the at least one piston at least partially defining a combustion chamber of the internal combustion engine, the moving being performed by a valve actuation mechanism that performs actions comprising; urging a sealing edge of the sleeve valve against a valve seat by an urging force generated by the valve actuation mechanism when the sleeve valve is moved to the closed position; and assisting, by a valve assistance feature, the valve actuation mechanism in resisting forces generated by the internal combustion engine in opposition to the urging force, at least one of the sleeve valve and the valve seat comprising the valve assistance feature, the forces generated by the internal combustion engine in opposition to the urging force comprising a pressure of combustion gases in the combustion chamber acting on an exposed surface of the sealing edge in a direction counter to a valve closing force of the valve actuation mechanism, the valve assistance feature comprising an interference angle between the sealing edge of the valve and the valve seat configured an interference angle between the sealing edge of the valve and the valve seat configured to reduce the exposed surface area by reducing formation of a gap opening between the sealing edge and the valve seat when the sleeve valve bends outwardly due to radially directed forces caused by combustion gas pressures in the combustion chamber, the interference angle comprising a difference between a first taper angle of the sealing edge and second taper angle of the valve seat, which are mismatched.

12. A method as in claim 11, wherein the valve actuation mechanism comprises a spring sized to ensure that the maximum gas pressure cannot lift the sealing edge off the valve seat.

13. A system as in claim 11 wherein the interference angle is formed between a first sealing surface on the sealing edge and a second sealing surface on the valve seat, the first sealing surface being shaped like a first section of a first tapering solid of rotation having a first apex toward which the first sealing surface tapers, the second sealing surface being shaped like a second section of a second tapering solid of rotation having a second apex toward which the second sealing surface tapers, the first tapering solid of rotation and the second tapering of rotation each sharing their axes of rotation with a central axis of the combustion chamber.

14. A system as in claim 13, wherein the first tapering solid of rotation comprises a first cone and the second tapering solid of rotation comprises a second cone.

15. A system as in claim 13, wherein the first apex and the second apex are both oriented toward the closed position, or wherein the first apex and the second apex are both oriented toward the open position.

16. A system as in claim 11, wherein the interference angle is based on a calculated maximum deflection of the sleeve valve due to a maximum pressure of the combustion gases in the combustion chamber, the interference angle causing an inner edge of the sealing edge to remain in contact with the valve seat even at the maximum deflection.

17. A system as in claim 11, wherein the internal combustion engine comprises an opposed piston engine, wherein the at least one piston comprises a leading piston at least partially encircled by the valve body and a trailing piston at least partially encircled by a second valve body of a second valve body of a sleeve valve, the leading piston and the second piston reciprocating between respective top dead and bottom dead center positions in an out of phase member manner such that the leading piston reaches its top dead center position prior to the trailing piston reaching its top dead center position to provide a variable compression ratio capability, the second sleeve valve comprising a second sealing edge that is urged against a second valve seat, and a second interference angle between the second sealing edge of the second sleeve valve and the second valve seat being smaller than the interference angle.

18. A system as in claim 11, wherein the internal combustion engine comprises an opposed piston engine, wherein the at least one piston comprises a primary piston at least partially encircled by the valve body and a secondary piston at least partially encircled by a second valve body of a second sleeve valve, the primary piston and the secondary piston reciprocating between respective top dead center and bottom dead center positions on respective first and second crankshafts, the second crankshaft being translatable along an axis of motion of the secondary piston such that the secondary piston in a lower compression ratio configuration has a top dead center position further from a center of the engine than the primary piston, the second sleeve valve comprising a second sealing edge that is urged against a second valve seat, and a second interference angle between the second sealing edge of the second sleeve valve and the second valve seat being larger than the interference angle.

19. The system of claim 1, wherein the closed position comprises forming a seal between the sealing edge and the valve seat to close the port.

* * * * *